US008776690B2

(12) United States Patent
Lebacher et al.

(10) Patent No.: US 8,776,690 B2
(45) Date of Patent: Jul. 15, 2014

(54) SLEEVE FOR ACCOMMODATING PROPELLANT CHARGE POWDER

(75) Inventors: Walter Lebacher, Aschau am Inn (DE); Alexander Huber, Groβkarolinenfeld (DE)

(73) Assignee: Nitrochemie Aschau GmbH (DE)

( * ) Notice: Subject to any disclaimer, the term of this patent is extended or adjusted under 35 U.S.C. 154(b) by 20 days.

(21) Appl. No.: 13/386,079

(22) PCT Filed: Aug. 3, 2010

(86) PCT No.: PCT/EP2010/004758

§ 371 (c)(1),
(2), (4) Date: Jan. 20, 2012

(87) PCT Pub. No.: WO2011/015346

PCT Pub. Date: Feb. 10, 2011

(65) Prior Publication Data

US 2012/0132098 A1 May 31, 2012

Related U.S. Application Data

(60) Provisional application No. 61/231,065, filed on Aug. 4, 2009.

(51) Int. Cl.
*F42B 5/192* (2006.01)
*F42B 5/188* (2006.01)

(52) U.S. Cl.
CPC ..... *F42B 5/192* (2013.01); *F42B 5/188* (2013.01)
USPC ..... 102/282; 102/431; 102/465; 86/19.5; 86/18

(58) Field of Classification Search
CPC ..... F42B 5/192; F42B 5/188
USPC ..... 102/431, 432, 282, 700, 464, 465; 86/18, 19.5, 1.1
See application file for complete search history.

(56) References Cited

U.S. PATENT DOCUMENTS 3,397,639 A * 8/1968 Alderfer ..... 102/202
3,617,593 A * 11/1971 Alderfer ..... 264/46.7

(Continued)

FOREIGN PATENT DOCUMENTS

DE 1578082 A1 7/1971
DE 1 918 320 9/1971

(Continued)

OTHER PUBLICATIONS

English translation of DE 3008996 A1, Mar. 24, 1981.*

(Continued)

*Primary Examiner* — James Bergin
(74) *Attorney, Agent, or Firm* — Thomas, Karceski & Karmilovich, P.C.

(57) ABSTRACT

The invention relates to a combustible sleeve for accommodating propellant charge powder, to munitions designed using such a sleeve, and to a production method for such sleeves. The sleeve according to the invention is designed for accommodating propellant charge powder and has a jacket wall made of combustible felted fibrous material and an inlay of intersecting threads in the jacket wall. The threads are disposed therein at a distance from one another such that felted fibrous material reaches through the regions between the threads. The method comprises the following steps: preparing a jacket wall made of combustible felted fibrous material and inserting an inlay made of intersecting threads into the jacket wall. The threads are disposed therein at a distance from one another such that the felted fibrous material extends through the regions between the threads.

4 Claims, 2 Drawing Sheets

(56) References Cited

U.S. PATENT DOCUMENTS

| | | | | | |
|---|---|---|---|---|---|
| 3,670,649 | A | | 6/1972 | Hartlein et al. | |
| 3,747,532 | A | * | 7/1973 | Berger | 102/282 |
| 3,901,153 | A | * | 8/1975 | Brabets et al. | 102/433 |
| 3,977,325 | A | * | 8/1976 | Jacobsen et al. | 102/465 |
| 4,068,489 | A | | 1/1978 | Priaroggia | |
| 4,178,207 | A | | 12/1979 | Oversohl | |
| 4,759,824 | A | | 7/1988 | Muller et al. | |
| 4,928,598 | A | | 5/1990 | Sabranski et al. | |
| 5,138,949 | A | * | 8/1992 | Swartout et al. | 102/431 |
| 5,243,914 | A | * | 9/1993 | Penner | 102/307 |
| 5,872,325 | A | * | 2/1999 | Feldmeier et al. | 102/334 |
| 6,523,476 | B1 | * | 2/2003 | Riess et al. | 102/431 |
| 6,910,422 | B2 | * | 6/2005 | Haider et al. | 102/431 |
| 7,024,999 | B2 | * | 4/2006 | Muskat et al. | 102/431 |

FOREIGN PATENT DOCUMENTS

| | | | |
|---|---|---|---|
| DE | 2058539 | A1 | 5/1972 |
| DE | 3008144 | A1 | 9/1981 |
| DE | 3008996 | A1 | 9/1981 |
| DE | 3927400 | C2 | 2/1991 |
| DE | 10044588 | A1 | 4/2002 |
| DE | 10256795 | A1 | 6/2004 |
| EP | 1123482 | B1 | 10/1999 |

OTHER PUBLICATIONS

English translation of DE 1578082 A1; Jul. 15, 1971.*

International Search Report for PCT/EP2010/004758, mailed Dec. 27, 2010.

* cited by examiner

SLEEVE FOR ACCOMMODATING PROPELLANT CHARGE POWDER

This application claims the priority of PCT Application Number PCT/EP2010/004758, filed Aug. 3, 2010, which is incorporated by reference herein in its entirety.

This invention relates to a combustible case for accommodating propellant charge powder, to ammunition formed with such case, and to a production method for such cases.

BACKGROUND

Cases as part of ammunition both for small-bore weapons and for large-bore weapons have long since been known and are commonly used. Above all, they serve for accommodating the propellant charge powder. Usually, cases have a circular-cylindrical and oblong hollow shape; the actual sheath here is referred to as jacket wall.

For producing a shell, the case generally is additionally equipped with a bottom comprising a primer. The same usually is made of metal, mostly of steel. For producing a cartridge, a projectile additionally is placed onto the free longitudinal end of the case opposite the bottom.

Combustible cases also are known in principle. They are burnt or consumed as a result of firing. If this occurs sufficiently free from residues, no case rests must be removed before the next shot. Ideally, only the bottom has to be ejected.

For combustible cases, a combustion as free as possible from residues therefore is desirable, in order to avoid an additional cleaning of the charge space or the barrel.

It is known to produce combustible cases from nitrocellulose and cellulose; in general with additives such as binder resin and stabilizers. Conventionally, a screen mold is vertically immersed into an aqueous pulp with nitrocellulose and cellulose. By means of negative pressure, the screen mold sucks in the fibrous pulp; there is formed a wet raw felt. In principle, this material can also be referred to as "fleece". However, the term "raw felt" has gained acceptance here. To achieve the final geometry and for dewatering, the raw felt also is compressed and heated at least at times.

The cases must have a certain mechanical stability. A small deformation may be tolerable, but there should not form a crack. Through a crack, propellant charge powder might leak—a safety risk which is not tolerated. According to some specifications, the cases therefore are designed with an additional, internally located bag for accommodating the propellant charge powder, a so-called powder bag.

The stability of the case is particularly relevant for tank ammunition, since here the requirements concerning the mechanical stability can be very pronounced, for example due to the handling within the tank and as a result of loads and movement shocks when attaching the cartridge. The invention is, however, not limited to tank ammunition.

DE 30 08 996 A1 discloses a method for producing combustible cases. It is proposed to roll fabric inlays into the raw felts during the felting operation. It was found that a case produced in this way can break up into several parts during an impact. The felt can detach from the inserted fabric over a large surface. In the worst case, the case is split into three separate parts, namely the fabric inlay and the raw felt which has detached from the inside and the outside of the fabric.

DE 36 19 960 A1 discloses a combustible case with additional reinforcements made of metal or plastics. These reinforcements can be embedded in the case or also be fixed on the same. If the reinforcements are embedded in the case, they are provided with holes, so that the rest of the case can burn through these holes. The reinforcements themselves, however, are not burnt.

SUMMARY

It is the object underlying the invention to indicate a mechanically robust case combustible free from residues for accommodating propellant charge powder. The object also relates to a corresponding production method and to corresponding ammunition.

The object is solved by a case for accommodating propellant charge powder with a jacket wall of combustible felted fibrous material and an inlay of intersecting threads in the jacket wall. The case is characterized in that the threads are spaced from each other such that felted fibrous material reaches through the regions between the threads.

As already set forth above, the invention is based on the observation that the parts of combustible cases can be detached from each other according to the teaching of DE 30 08 996, and on the finding that the cases cannot be burnt free from residues according to DE 36 19 960; with this teaching, a combustion free from residues was omitted in favor of the stability.

Furthermore, the invention is based on the finding that in the first-mentioned teaching from the prior art the fabric prevents a continuous intimate connection of the fibrous material and thus promotes falling apart of the case.

The invention also is based on the observation that threads can be combustible and nevertheless provide stability, and on the idea to achieve mechanical stability by inserting threads, while at the same time choosing the distances between the threads so large that the felt remains a unit, i.e. is not severed over a large surface—in contrast to the prior art, where the fabric severs the felt over a large surface because of the closely spaced threads, warp and weft.

The success of the invention above all results from the fibrous material reaching through the spacings between the threads. In other words, a formation of layers in the felt of the case is avoided.

Since the inlay promotes the mechanical robustness of the case, reference can also be made to an "armor".

Thus, the case according to the invention basically consists of a fibrous felt, into which an armor is embedded in addition. Fibers reach through the armor. Even without the armor the case would be dimensionally stable, although not as robust and fracture-proof as according to the invention.

The threads of the inlay in principle can lie on top of each other at any angle. In particular, the threads can be oriented orthogonally relative to each other.

The threads for example can be made of cotton or carbon fibers. What is desirable is a comparatively high tear strength and an at least temporary heat resistance. During the raw felt production, the material is heated to about 135 ac for some minutes, in general for 5 minutes. The threads should be able to withstand this temperature without damage and nevertheless be combustible free from residues in the sense of the invention. Preferably, the threads can even be exposed to a temperature of more than 140 ac for 5 minutes, without this having a disadvantageous effect on their mechanical properties. Preferably, the threads also are relatively thin as compared to the thickness of the jacket wall, so that the inlay does not lead to a higher wall thickness.

The term "thread" here is used in the plural form mostly for linguistic reasons. In principle, however, an embodiment in which a single thread is inserted into the jacket wall should not be excluded. During production of the raw felt, the thread might be wound into the same, for example, and cross over itself.

The term "free from residues" should not be understood here in absolute terms, but should be interpreted according to practical requirements. In accordance with the invention, a case is burnt free from residues when ammunition can be reloaded without first having to clear the charge space from case rests.

In general, a robust case combustible free from residues thus is indicated. In particular, inserting a powder bag can become superfluous. In principle, cases according to the invention possibly can even be constructed thinner than conventional cases—and this with equal mechanical robustness. This would have the advantage that more propellant charge powder can be used and the performance of the ammunition thus can be increased. The invention acts against a leakage of propellant charge powder possibly even in the case of a fracture or injury of the jacket.

Preferably, the threads form a net, so that the fibrous material reaches through the meshes of the net.

For forming the net, the threads for example can be connected with each other by knots. They can, however, also be connected with each other in some other way, for example by welding spots or by means of an adhesive.

Preferably, a net made of cotton is used as inlay. Corresponding nets for example can be purchased at low prices and prefabricated as fishing nets.

It is also preferred to at least once insert the net completely along the circumference of the jacket wall. Weak spots in the jacket wall thus can be avoided. Inserting the net for example can be effected by winding, and in so far reference can also be made to windings for the sake of linguistic simplicity.

The net also can be inserted repeatedly along the circumference of the jacket wall. Particularly preferably, the net is wound about 360° five to eight times. In principle, a higher mechanical stability can be expected with an increasing number of windings. In general, however, it is not desirable that the thickness of the jacket wall of the case increases. Therefore, the number of the windings of the net is limited in particular by the desired wall thickness. This is the case above all when the net is knotted, since the knots have a certain thickness.

If the threads of the net do not burn as well as the fibrous material of the case, it may also be expedient to limit the number of the windings, in order to further ensure that the case burns free from residues.

Eight windings were found to be particularly useful.

When attaching the raw felt, the net can be wound up during formation of the same. There is obtained a spiral-shaped inlay in the jacket wall. Corresponding cases can advantageously be produced with the production method described below.

Preferably, the spiral-shaped windings are spaced from each other to such an extent that the flat sides of the net are at least partly separated from each other by the fibrous material of the jacket wall. Thus, it is prevented that the threads of different windings directly lie on top of each other, which might provoke mechanical weak spots.

The meshes of the net preferably have a width of 7 to 20 mm, more preferably of 10 to 18 mm, particularly preferably of 10 to 15 mm.

This width has proven successful for the relevant types of ammunition. If the mesh width is too small, the fibrous material cannot sufficiently reach through the meshes, in order to ensure a sufficient coherence of the felt. If the mesh width is too large, the mechanical stability of the case is not supported in a satisfactory way. Beside the geometry of the case, the ideal mesh width also can depend on the properties of the fibrous material. In particular, it is preferred when the cellulose fibers, which typically have a length of 2 mm to 4 mm, can reach well through the meshes.

The invention also relates to a method for producing a case according to the invention. This method comprises at least the following steps: Fabricating a jacket wall of combustible felted fibrous material and inserting an inlay of intersecting threads into the jacket wall. The method is characterized in that the threads are spaced from each other such that felted fibrous material reaches through the regions between the threads.

In the production method, a screen mold for forming the case preferably is oriented horizontally along its axis of rotation. The screen mold is at least partly immersed into a pulp with the fibrous material. The fibrous material is sucked in by means of negative pressure, so that a raw felt is attached on the screen mold.

To ensure that the concentration of the fibrous material in the aqueous pulp can be kept constant, it is preferred to immerse the screen mold into a circulating pulp—in contrast to a trough without open inlets and outlets, in which merely an only limited amount of fibrous material is present.

Preferably, the net is wound into the raw felt formed during attachment of the fibrous material. There is automatically obtained a spiral-shaped inlay, in which the individual windings of the net also are separated from each other by fibrous material.

Preferably, the net is unwound from a supply roll. This is particularly easy in terms of production technology.

At the beginning of winding up, the loose end of the net can be attached to the raw felt formed on the screen mold. Under favorable production conditions, the net already has so intensively united with the raw felt formed after a 60° rotation, that merely by further rotating the screen mold the supply roll for the net can be unwound.

The invention also relates to ammunition with a case according to the invention. Such ammunition can be both cartridges and shells.

Preferably, the propellant charge powder is filled in without inserted powder bag. This does not only save costs and effort in the production, but also allows to incorporate more propellant charge powder.

The preceding and the following description of the individual features relates both to the case and to the production method and the ammunition, without this being explicitly mentioned in detail in each case; the individual features disclosed can also be essential for the invention in combinations other than those shown. Preferred aspects are also indicated in the dependent claims.

In the following, the invention will also be explained in detail with reference to exemplary embodiments without wanting to limit the invention to the examples.

DETAILED DESCRIPTION

Figure 1:
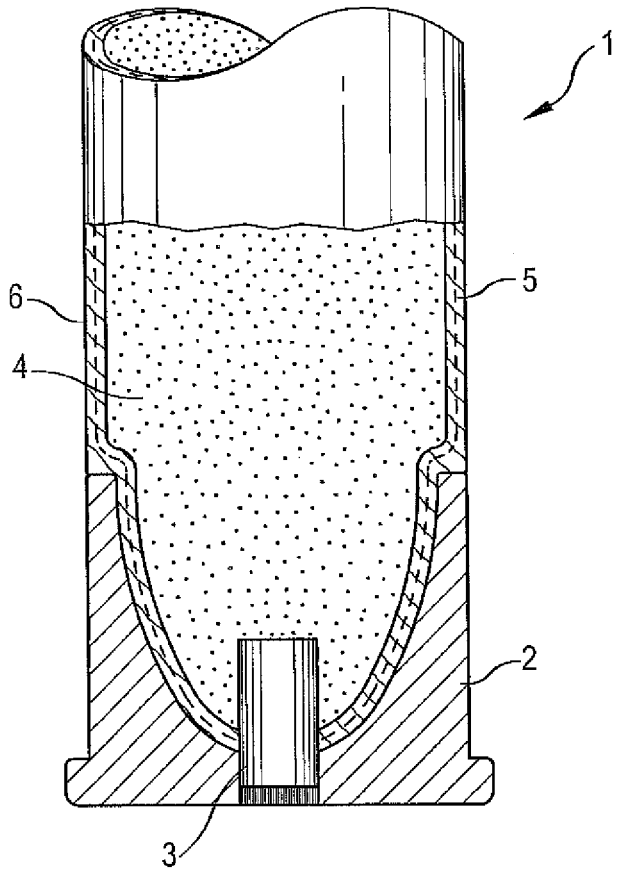
FIG. 1 schematically shows the lower part of a shell according to the invention in a longitudinal section.

FIG. 1 shows a case 6 according to the invention as part of a shell 1 according to the invention. The case 6 is oblong and circular-cylindrical and accommodates the propellant charge powder 4 in its interior. A net 5 is inserted into the jacket wall of the case 6.

At the lower end of the shell 1 a bottom 2 made of brass is mounted with a primer 3.

The case 6 is made of felted cellulose and nitrocellulose fibers as well as conventional additives.

The inserted net 5 is a fishing net 5 made of cotton with orthogonally extending knotted threads. The threads have a thickness of 0.2 mm and a strength of 40 Nm.

The felted fibrous material reaches through the 15 mm wide meshes of the net 5. The net 5 is each spirally wound about 360° eight times. Between the individual windings, sufficiently felted fibrous material is present, in order to separate the individual windings from each other.

Figure 2:
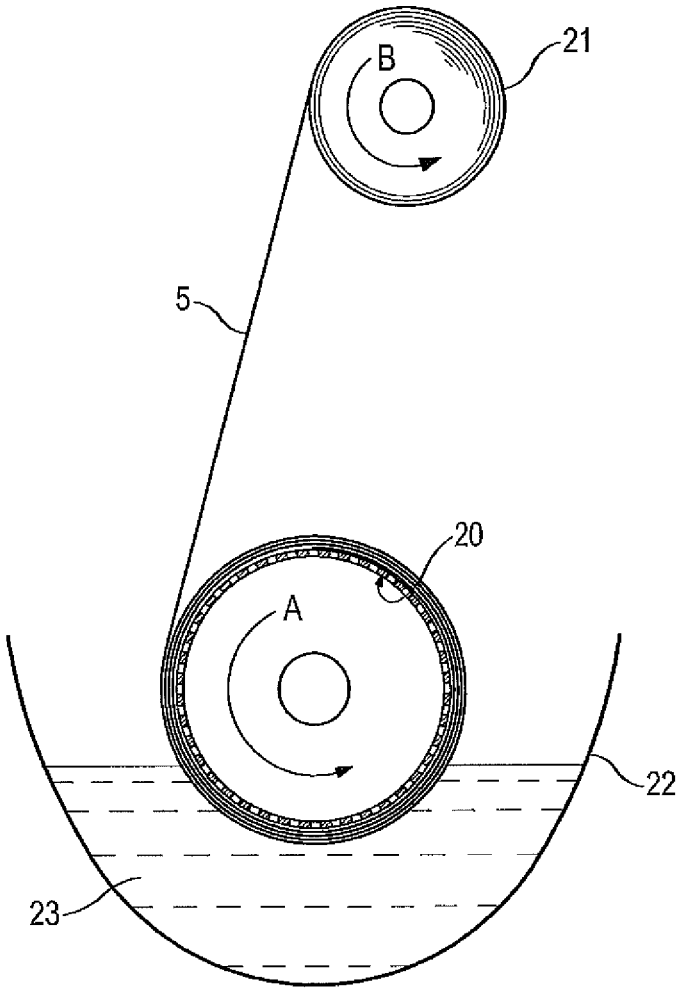
FIG. 2 shows a section through a schematic diagram of a production plant for carrying out the production method according to the invention.

FIG. 2 shows a cross-section of a production plant for cases according to the invention for carrying out the production method according to the invention.

The production plant comprises at least one screen mold 20, a supply roll 21 and a trough 22 with an aqueous pulp 23. A lower portion of the horizontally oriented screen mold 20 is immersed into the aqueous pulp 23. Cellulose fibers and nitrocellulose fibers in particular are floating in the aqueous pulp. To keep the concentration of the fibrous material constant during the production process, the aqueous pulp 23 is constantly renewed by a corresponding flow.

In the screen mold 20 a negative pressure is generated, so that the same sucks in fibrous material from the pulp 23. The screen mold 20 rotates slowly, for example five times per minute, so that a raw felt is formed along its surface. The direction of rotation is indicated by the arrow A. A net 5 is attached to the raw felt formed (the raw felt itself is not shown in the Figure). The net 5 is rolled off from the supply roll 21. The rotation of the supply roll 21, indicated by the arrow B, results from the rotation of the screen mold 20, transmitted by the net 5.

As soon as the net 5 is wound into the raw felt over about 60°, it possibly can already hold on its own.

While the raw felt is attached further, the net 5 is eight times wound into the raw felt over 360°. As during winding more and more fibrous material is attached and the raw felt grows, fibrous material also is accumulated between the windings of the net 5.

The raw felt with the inserted net 5 subsequently is compressed and heated for about five minutes at 135° C.

For producing a shell, a bottom with primer also is attached and the propellant charge powder is filled in. For producing a cartridge, a projectile is mounted in addition.

The invention claimed is:

1. A case for accommodating propellant charge powder with a jacket wall of combustible felted fibrous material and an inlay of intersecting threads in the jacket wall, wherein the threads form a net and are spaced from each other such that felted fibrous material reaches through the regions between the threads of the net, and wherein the net is spirally inserted into the jacket wall several times along its circumference.

2. The case according to claim 1, wherein the net is made of cotton.

3. The case according to claim 1, wherein the regions between the threads of the net have a width of 7 mm to 20 mm.

4. The case according to claim 1, wherein the flat sides of the net are at least partly separated from each other by the fibrous material of the jacket wall.

* * * * *